United States Patent [19]

Uchiyama et al.

[11] Patent Number: 4,781,097

[45] Date of Patent: Nov. 1, 1988

[54] ELECTRONIC DRUM INSTRUMENT

[75] Inventors: Shigeru Uchiyama, Sayama; Kazuhisa Nakamura; Kenichi Tsutsumi, both of Tokyo, all of Japan

[73] Assignee: Casio Computer Co., Ltd., Tokyo, Japan

[21] Appl. No.: 905,069

[22] Filed: Sep. 8, 1986

[30] Foreign Application Priority Data

Sep. 19, 1985 [JP] Japan ..... 60-207151
Sep. 27, 1985 [JP] Japan ..... 60-214123

[51] Int. Cl.[4] ..... G10H 1/057; G10H 1/46; G10H 7/00

[52] U.S. Cl. ..... 84/1.13; 84/1.26; 84/1.27; 84/DIG. 12

[58] Field of Search ..... 84/1.01, 1.03, 1.04, 84/1.09, 1.24, DIG. 24, DIG. 12, 1.08, 1.06, 1.27, 1.1, 1.13, 1.14, 1.26; 340/347 SH

[56] References Cited

U.S. PATENT DOCUMENTS 3,551,580 12/1970 Glenn .
3,553,339 1/1971 Dominguez .
3,956,959 5/1976 Ebihara et al. .
4,202,237 5/1980 Hakansson ..... 84/103
4,418,598 12/1983 Klynas .
4,479,412 10/1984 Klynas .

OTHER PUBLICATIONS

Anderton, Electronic Projects for Muskians, Guitar Player Books, 1980, p. 178.

*Primary Examiner*—S. J. Witkowski
*Attorney, Agent, or Firm*—Frishauf, Holtz, Goodman & Woodward

[57] ABSTRACT

A plurality of drum pads are each provided with a respective piezoelectric pick-up. The output of each piezoelectric pick-up is fed to a corresponding envelope-extracting circuit. The envelope signal extracted by the envelope-extracting circuit is converted by an A/D converter into a digital signal which is fed to a CPU. The CPU feeds a tone designation signal to a tone generator unit according to parameter data from a parameter data setter and the digital signals noted above, thereby causing generation of a corresponding drum sound.

38 Claims, 9 Drawing Sheets

28
CHANNEL 1
CHANNEL 8
TONE GEN UNIT
27
VCC
121
SIGNAL CONVERTER
PARAMETER SET/DISPLAY UNIT
9
ALU
25
TIMER
22
RAM
ROM
21
20
26
GATE CONTROL SIGNAL G1~G8
END SIGNAL
A/D START SIGNAL
A/D CONVERTER
14
SC
ANALOG TRIGGER SIGNAL GENERATOR
12
10
11
13 ENVELOPE EXTRACTING CIRCUIT
VR
16
17
18
19
24
23
15
G1
G8
L1
L8
1-1
1-8

FIG. 7

| TONE DATA | CHANNEL NO. | CHANNEL CODE | PITCH | KEY-ON | KEY-OFF | TONE |
|---|---|---|---|---|---|---|
| 1 ST TONE DATA | 1 | 01 | 15 | 40 | 00 | CLOSED HIGHHAT |
| 2 ND TONE DATA | 2 | 02 | 20 | 40 | 00 | OPEN HIGHHAT |

ELECTRONIC DRUM INSTRUMENT

BACKGROUND OF THE INVENTION

This invention relates to an electronic musical instrument for generating sound according to vibrations of a member vibrated for musical performance and, more particularly, to an electronic musical instrument, such as an electronic percussion instrument called an electronic drum.

Heretofore, various electronic musical instruments called electronic drums have been developed. Such electronic drums are disclosed in U.S. Pat. No. 3,551,580 (patented on Dec. 29, 1970), U.S. Pat. No. 3,553,339 (patented on Jan. 5, 1971), U.S. Pat. No. 3,956,959 (patented on May 18, 1976), U.S. Pat. No. 4,418,598 (patented on Dec. 6, 1983), and U.S. Pat. No. 4,479,412 (patented on Oct. 30, 1984).

In any of these prior art electronic musical instruments, vibrations produced by striking a vibration member called a pad with a drumstick or a hand is converted by a pick-up or a transducer into an electric signal, and an amplifier is controlled for tone volume control according to this electric signal.

This means that a circuit constituting the electronic drum performs analog signal-processing. This is unsatisfactory from the point of view of obtaining a variety of percussion instrument sounds, and thus the prior art electronic drum lacks flexibility.

SUMMARY OF THE INVENTION

An object of the invention is to provide a digital electronic musical instrument having a signal converter for converting analog vibration signals into a digital signal, thus permitting a variety of different forms of sound to be produced. Particularly, an envelope signal extracted from an electric signal produced by the vibrations produced in a musical performance is digitally analyzed, and the start and end of generation of a sound such as a percussion instrument sound is controlled according to the result of the analysis.

More specifically, according to the invention there is provided an electronic musical instrument, which comprises means for generating an electric signal representing vibrations of a vibration member operative for musical performance, and tone generating means for generating a predetermined tone signal according to the electric signal from the signal generating means, which electronic musical instrument further comprises envelope-extracting means for extracting an envelope signal from the electric signal, analog-to-digital conversion means for converting the envelope signal from the envelope-extracting means into a digital signal, and control means for controlling the tone generating means according to the digital signal from the analog-to-digital conversion means, to designate at least the start or end of generation of a desired tone.

BRIEF DESCRIPTION OF THE DRAWINGS

FIG. 7 a view showing parameter data-designating tones generated in dependence on the state of a foot switch.

DETAILED DESCRIPTION OF THE PREFERRED EMBODIMENT

Now, an embodiment of the invention will be described with reference to the drawings.

Figure 1:
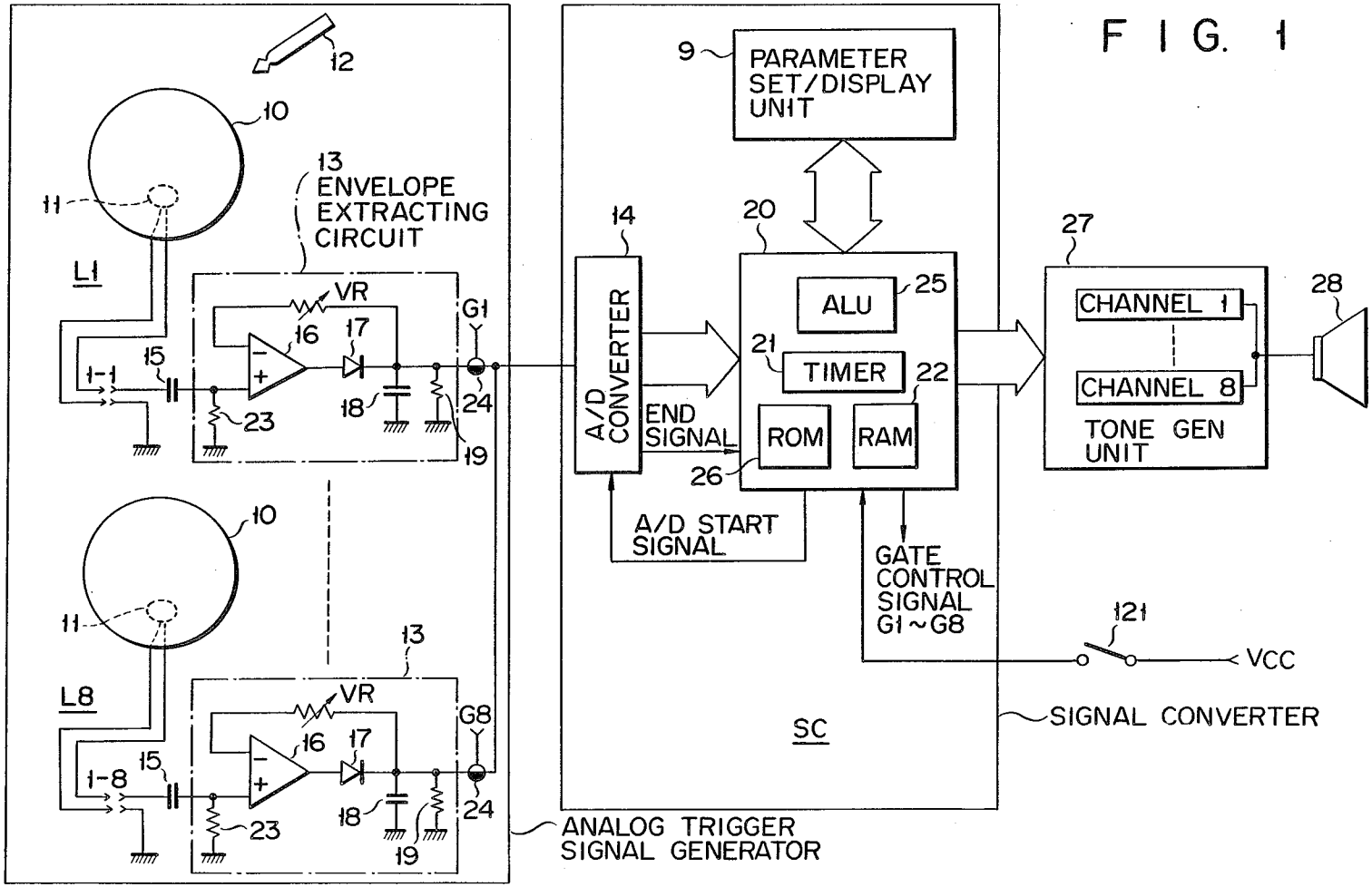
FIG. 1 schematic representation of an embodiment of the invention.

FIG. 1 shows the overall circuit construction of an embodiment of the invention applied to an electronic percussion instrument.

Elements 10 to 13 constitute an analog trigger signal generator, elements 14, 9 and 20 constitute a signal converter, and element 27 is a tone generator unit. In this electronic musical instrument, eight analog trigger-signal generators or lines L1 to L8 are used. As will be described later in detail, the signal converter can freely set such parameters as timbre, pitch, and channel to be allotted to the individual trigger-signal generators (i.e., the individual lines L1 to L8). At the time of performance, the performer plays eight drums, using drumsticks in eight lines L1 to L8. In consequence, analog trigger signals are generated from lines L1 to L8 and fed to the signal converter SC. The signal converter SC feeds a musical tone control signal to the tone generator unit 27 in a timing related to that of the generation of each analog signal. The tone control signals include key-on commands and tone volume level-designation data (these commands and designation data being determined through level analysis of the input signal) and also channel, timbre, and pitch designation data based on setting. The designated channel of the tone generator unit 27 is operated according to a tone control signal from the signal converter SC, whereby a tone signal of designated timbre, pitch, and tone volume is generated. The generated tone signal is sounded through a loudspeaker 28. Tone generator unit 27 can generate tone signals corresponding to the maximum number of tones to be produced at a time. It has a plurality of internal tone generation channels, which may be separate hardware channels or which can operate in a time-division multiplexing arrangement.

In further detail, reference numeral 10 in each of lines L1 to L8 designates each drum pad. When drum pad 10 is struck by drumstick 12, its vibrations are picked up by piezoelectric pick-up 11, in order to be converted into an analog electric signal. Piezoelectric pick-up 11 may be replaced with a hall element or a machanical-electric transducer, or a microphone. Further, it is possible to permit detection of the depression force rather than the vibrations of the drum pad. At any rate, the analog electric signal which represents vibrations of the drum pad is fed through a corresponding one of input terminals 1-1 to 1-8, to envelope-extracting circuit 13 of each lines L1 to L8.

Envelope-extracting circuit 13 includes operational amplifier 16. Coupling capacitor 15 and grounded resistor 23 are connected to a non-inverted input side of operational amplifier 16, to cut a DC component in the non-inverted input. Diode 17 is connected to the output side of operational amplifier 16. The cathode of diode 17 is connected to a grounded time-constant circuit consisting of capacitor 18 and resister 19. The output of the cathode side of diode 17 is fed back to variable resistor VR, which can be adjusted by sensitivity adjustment volume control knobs 2 (see FIG. 2B) to the inverted input terminal of operational amplifier 16. The gain, and hence sensitivity, of operational amplifier 16 is thus determined by the resistance provided by variable resistor VR. The response characteristic is tentatively determined by the time-constant circuit.

A/D converter 14 converts an envelope signal for 8 lines L1 to L8 provided from envelope-extracting circuit 13, into a corresponding digital signal The conversion is effected in a timing related to the time-division processing of microcomputer 20 on input data on 8 lines L1 to L8. More specifically, microcomputer 20 drives 8 gates 24 constituting a multiplexer, on a time-division basis, and A/D converter 14 effects A/D conversion during a time slot during which each gate is held enabled by the gate control signals G1 to G8. More specifically, while line L1 is selected, microcomputer 20 enables gate 24 related to gate control signal G1 and produces an A/D conversion start signal commanding a conversion operation to A/D converter 14. In response to this signal, A/D converter 14 effects A/D conversion and, when this is completed, it sends an end signal back to microcomputer 20. In response to this end signal, microcomputer 20 fetches the converted data, and then selects line L2, i.e., the second analog trigger-signal generator, and enables gate 24 related to gate control signal G2, thus repeating the above operation.

Microcomputer 20 is the center of the signal converter, and it includes ROM 26 where programs are stored; RAM 22 to store various data, for example, key-on command, key-off command code, tone volume designation code, timbre designation code, pitch (note) designation code, channel designation code, and also data fed from A/D converter 14; ALU 25 for excuting various arithmetic operations; and software timer 21 used for analysis of input data from A/D converter 14.

The main function of microcomputer 20 is a data-setting (or edit) mode. In this mode, microcomputer 20 sets preset parameters from parameter set/display unit 9 which serves as an input/output unit in internal RAM 22, and also causes display of parameter data set in RAM 22 on parameter set/display unit 9. In the play mode, microcomputer 20 effects analysis of data fed from A/D converter 14 and provides a tone control signal to tone generator unit 27 according to the result of the analysis.

Microcomputer 20, as described above, causes A/D converter 14, which is an interface for a plurality of (i.e., eight in this case) analog trigger-signal generators L1 to L8, to convert data for the individual signal generators and fetches the result of conversion.

Now, the input data level analysis, which is performed by microcomputer 20 on a time-division basis, will be briefly described. Its details will be described with reference to FIG. 5 and FIG. 6A.

In the input data level analysis, microcomputer 20 determines the level of data fed from A/D converter 14 and, if the level exceeds a certain value (i.e., trigger level), it saves the input data in RAM 22. Subsequently, microcomputer 20 executes peak detection to detect the maximum value generated from the pertinent analog trigger signal generator. More correctly, a predetermined number of data subsequent to the trigger level are saved, and the strength of impact of drumstick 12 on drum pad 10 is estimated by finding out the maximum value. According to this maximum value, microcomputer 20 designates a tone volume level and feeds a key-on command to tone generator unit 27. Subsequently, microcomputer 20 continues to monitor the input data level. When the input data level becomes lower than a predetermined level, it starts timer 21. When time-out of timer 21 occurs with the input data level remaining lower than the predetermined level, microcomputer 20 feeds a key-off command to tone generator unit 27. At this time, data is transferred through MIDI (musical instrument digital interface).

In this embodiment, microcomputer 20 feeds a key-on command together with various parameter data, to tone generator unit 27. The various data are of channel designation code, tone program designation code, and pitch designation code, these codes being set for each input data source. The channel designation code is a command for designating a channel to be used in tone generator unit 27. The timbre program designation code is a command for designating a timbre program to be used in the channel. The pitch designation code is a command for designating the pitch (i.e., note) of tone to be generated by tone generator unit 27.

The above parameter data-setting is performed via parameter set/display unit 9 which serves as an input/output unit. The detailed construction of parameter set/display unit 9 will now be described with reference to FIGS. 2A, 2B.

Figure 2A:
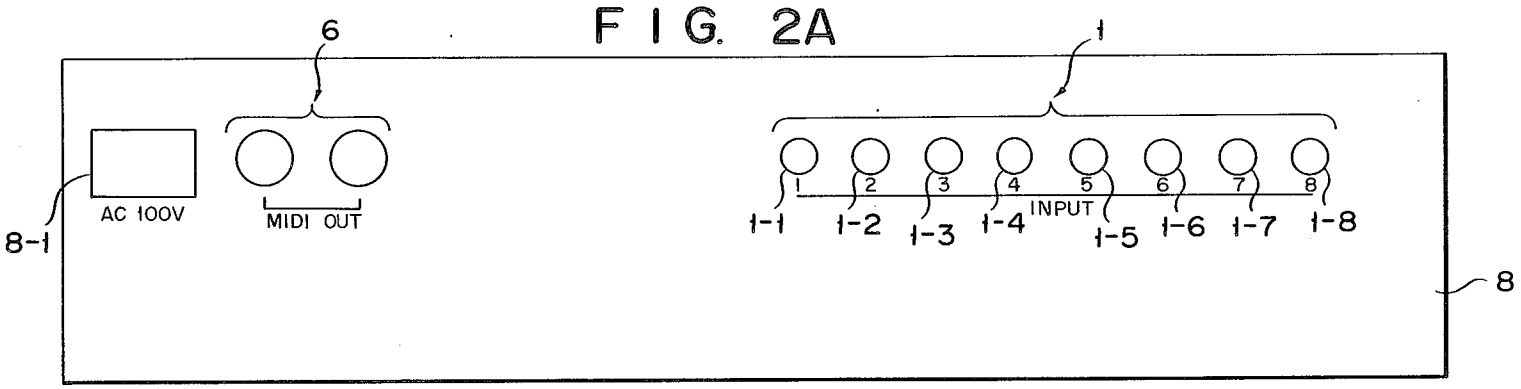
FIG. 2A and FIG. 2B show, in combination, a view showing a parameter data set/display unit.
Figure 2B:
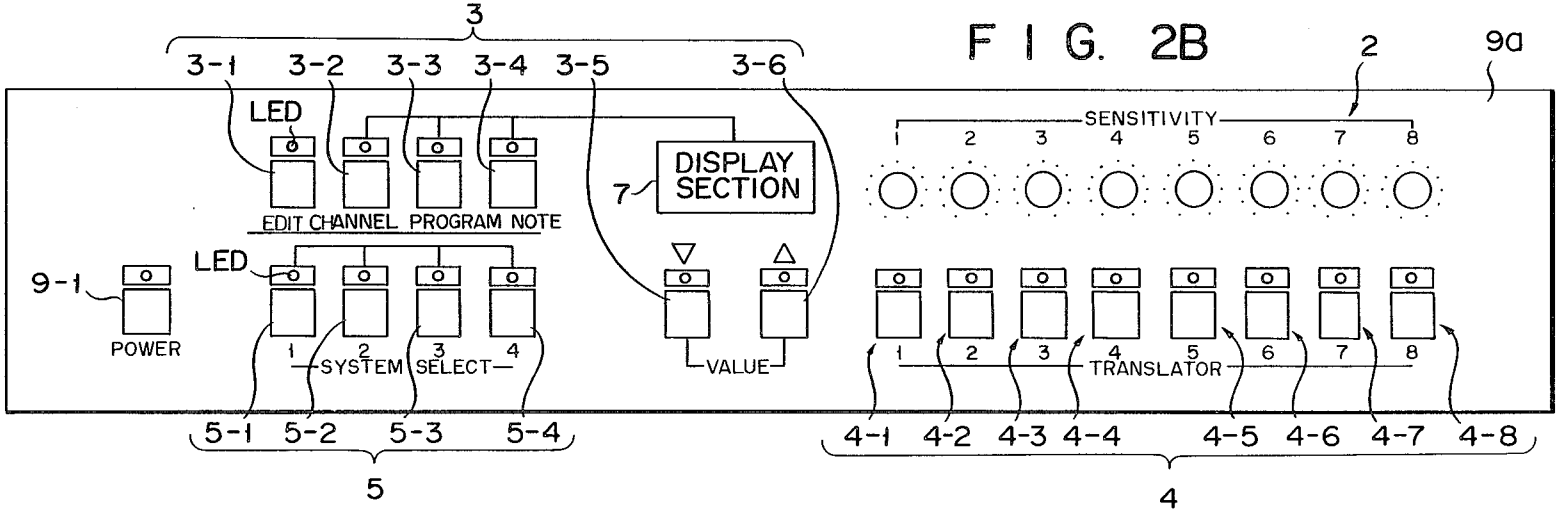

FIG. 2B shows operating panel **9*a* on the front of the signal transducer, and FIG. 2A shows input/output terminal panel 8 on the back. Operating panel 9*a* corresponds to parameter set/display unit 9, and it includes part of the analog trigger-signal generator and the entirety of the signal converter. More specifically, envelope-extracting circuit 13, A/D converter 14, and microcomputer 20 are provided in the inside. Input/output terminal panel 8 has input terminals 1-1 to 1-8 to which signals from individual drum pads 10 are fed, and output terminal 6 from which a control signal is fed to tone generator unit 27**.

Reference numeral 2 designates sensitivity adjustment volume control knobs. For example, the resistance of feedback register VR of envelope extracting circuit 13 related to input terminal 1-1, is adjustable by operating the first control knob. Thus, the sensitivity with respect to the input signal from line L1, i.e., the first analog trigger-signal generator is adjusted.

Reference numerals 3 to 5 designate switch groups of various setting and selection switches. An LED is provided above each switch. When the LED is "on", it indicates that the corresponding switch is functioning correctly. Reference numeral 7 designates a display section which constitutes part of parameter set/display unit 9. Various data are displayed on the display surface of display section 7. Designated as 8-1 is an AC power source connector, and 9-1 is a power switch.

In further detail, designated as 3-1 is a mode switch, which can switch the edit mode and play mode. When the LED of this switch is "on", it indicates the edit mode. Designated as 3-2 is a channel switch. When the LED of this switch is "on", it is possible to set a channel. The channel number can be set by operating up/down switches 3-5 and 3-6. Designated as 3-3 is a timbre program switch. When this switch is depressed once, timbre program selection is possible, and the corresponding LED is turned on. Designated as 3-4 is a pitch (note) switch. When the LED of switch 3-4 is "on", a note can be set, using keys 3-5 and 3-6.

Designated as 4 is a switch group for selecting each line (i.e., each analog trigger-signal generator). In this embodiment, there are eight input lines, so that eight line switches 4-1 to 4-8 are provided. For example, when effecting parameter data-setting with respect to line L1, i.e., the input line connected to input terminal 1-1, line L1 is selected by depressing key 4-1.

Thus, channel designation code data, timbre program designation code data, and pitch designation code data are stored in RAM 22 in microcomputer 20, such that these data are allotted to the eight lines and can be accessed independently. Microcomputer 20 further has four programmable areas each with an eight-line data set, and these areas are selected by system selection switches 5-1 to 5-4. More specifically, the 8-line data for the first set is selected by depressing switch 5-1, the data for the second set by depressing switch 5-1, the data for the third set by depressing switch 5-3, and the data for the fourth set by depressing switch 5-4.

The data group for each set corresponds to an electronic musical instrument system. That is, when a data group for a particular set is used at the time of performance, an electronic musical instrument system is operated. This means that the present embodiment has four electronic musical instrument systems, that is, four sets of tones generated by operating drum pads 10 are programmable prior to the performance.

It is to be understood that parameter data can be freely set and altered by operating the switches of groups 3 to 5. A system is selected by using switch group 5; a line in the same system is selected by using switch group 4; channel, program, and timbre setting modes are set for the same line by using switches 3-2, 3-3, and 3-4, and the alteration of the channel, program, and pitch are performed by using switches 3-5 and 3-6.

Figure 3A:
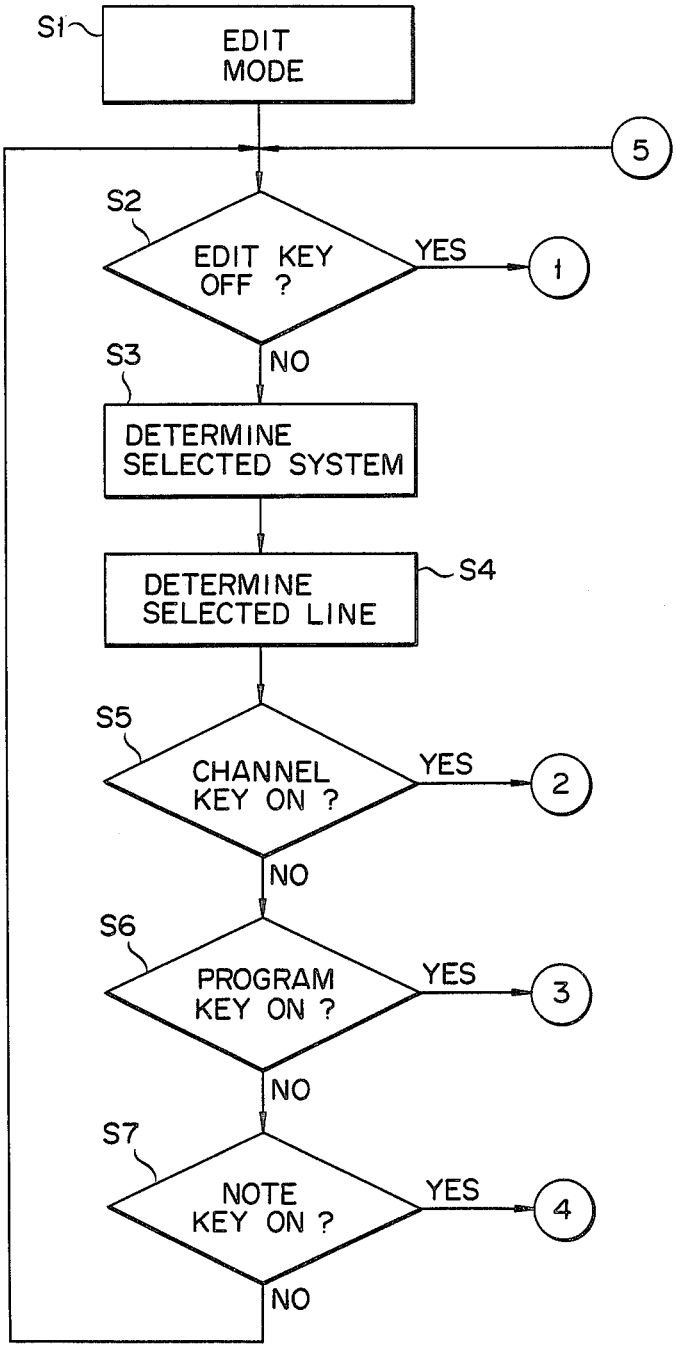
FIG. 3A and FIG. 3B show, in combination, a flow chart illustrating the operation of parameter setting.

An operation of the embodiment having the above construction will now be described with reference to the flow charts of FIGS. 3A, 3B, and 4.

The description will be made first with respect to the processing of the setting and alteration of parameter data (in the edit mode) with reference to FIGS. 3A, 3B.

In step S1, the edit mode is detected. Then, in step S2, microcomputer 20 effects a check as to whether mode switch 3-1 is "off", i.e., a check as to whether the play mode or edit mode is required. If it is detected that the mode switch is "off", the play mode is detected, in step Pl as shown in FIG. 4. If the mode switch is not "off", the routine goes to step S3 of a check of the state of the system selection switches of group 5, to determine the selected system. In subsequent step S4, a check of the state of the line selection switches of group 4 is performed, to determine the selected line. In subsequent step S5, a check of the state of channel switch 3-2, i.e., a check as to whether channel switch 3-2 is "on", is performed. If the channel switch is not "on", the routine goes to step S6 of a check of the state of timbre program switch 3-3, i.e., a check as to whether the timbre program switch is "off". If the timbre program switch is not "on", the routine goes to step S7 of a check of the state of pitch (note) switch 3-4, i.e., a check as to whether note switch 3-4 is "on". If the pitch (note) switch is not "on", the routine goes back to step S2.

Figure 3B:
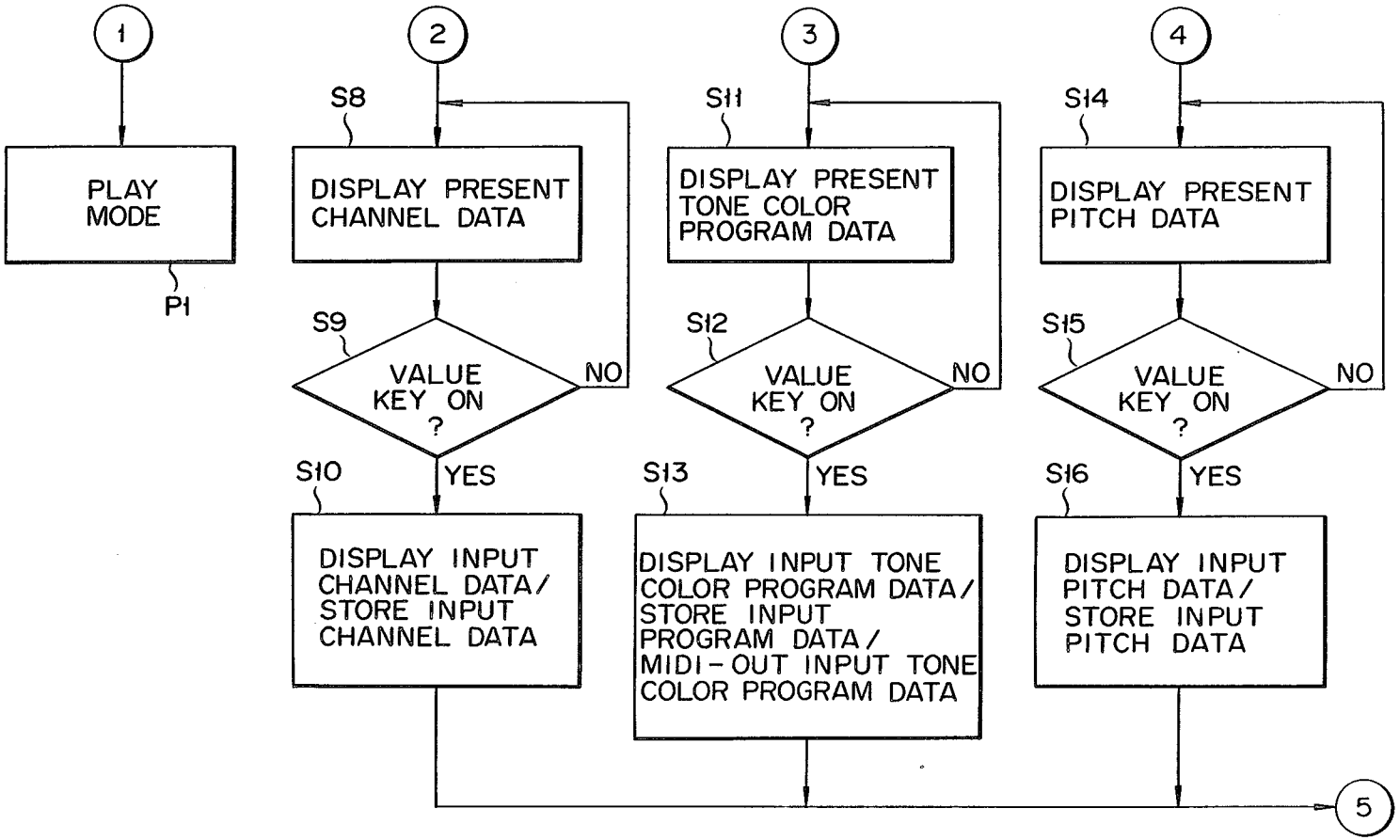
Figure 4:
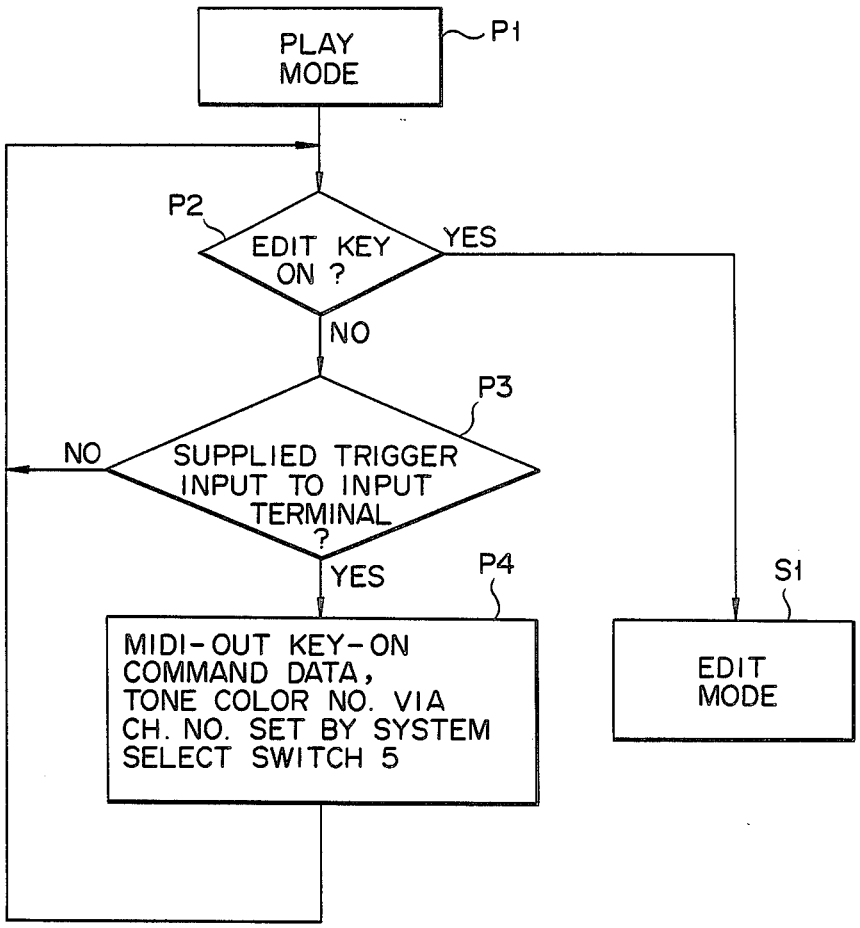
FIG. 4 is a flow chart briefly showing operation of the music in play mode.

If it is detected in step S5 that the channel switch is "on", in step S8 of FIG. 3B, channel data allotted to the system line determined in steps S3 and S4 is read out from RAM 22 and is displayed as prevailing channel data on display section 7. Then, in step S9, a check to determine whether one of switches 3-5 and 3-6 is "on", is performed. If one of these switches is "on", the routine goes to step S10, in which ALU 25 effects alteration of channel data, the new data being written in RAM 22 and displayed on display section 7. Thereafter, the routine returns to step S2.

If it is detected, in step S6, that the program switch is "on", steps S11 through S13 are executed. Steps S11 and S12 are, respectively, like steps S8 and S9. A difference is that these steps are executed based not on channel data but on timbre program designation data. In step S13 subsequent to step S12, in addition to the process of writing the new timbre program data in RAM 22 and displaying the data on display section 7, output processing with respect to the analysis is executed so that the performer can confirm aurally the alteration of the parameter data. More specifically, microcomputer 20 prepares new parameter data together with a key-on command and provides these data as tone control signal to tone generator unit 27. In response to this signal, tone generator unit 27 operates the designated channel and executes the designated timbre program, thus producing a tone signal according to the designated pitch data. Thus, the tone of the new designated timbre and pitch is provided through loudspeaker 28. After completion of step S13, the routine goes back to step S2.

If it is detected, in step S7, that the note switch is "on", steps S14 through S16 are executed. Steps S14, S15, and S16 correspond to steps S8, S9, and S10. A difference is that these steps are executed based not on channel data but on note or pitch data.

Now, the operation in the play mode will be described with reference to FIG. 4.

The play mode is detected in step P1. Then in step P2 a check of the state of mode switch 3-1, i.e., a check as to whether the edit mode is required, is performed. If it is detected that the edit mode is required, the edit mode is set in step S1. Otherwise, the play mode is continued, and step P3 is executed, in which input data is analyzed. The flow chart of FIG. 4 is very simplified. Actually, microcomputer 20 commands the time-division basis A/D conversion noted above to A/D converter 14 and fetches input data of the selected line according to the conversion output of A/D converter 14 for level analysis. If it is detected from the result of analysis of input data for a certain line that "a predetermined trigger level is exceeded by the input data" and "detection of the peak of the input data" is effected, the routine goes to step P4, in which microcomputer 20 reads out, from RAM 22, key-on command (which is thought to be generated when the input data level is detected to be above the trigger level), a tone volume level designation code (which is determined from the detected peak of the input data), as well as preset parameter data allotted to the selected line of the used system, i.e., channel designation code, timbre program designation code, and pitch (note) designation code, and produces from these data a tone control signal in a predetermined format suited to, and which is then, fed to tone generator unit 27. Preferably, before providing the key-on command, microcomputer 20 feeds a timbre program designation code for each channel to tone generator unit 27 to be ready for a subsequent percussion operation. Tone generator unit 27 generates a tone signal according to the tone control signal fed from microcomputer 20, and the tone signal is fed to and sounded from loudspeaker 28, with designated timbre and pitch. Until the input data reaches the trigger level, the routine returns to step P2 for the mode check, and the operation described above is repeated for the next line. Although not shown in FIG. 4, if it is detected in the input data analysis process of step P3, that the input level has become lower than a certain level, microcomputer 20 feeds a key-off command to tone generator unit 27 to discontinue the tone.

The overall construction and operation of the embodiment have been described so far. Now, the description will be mainly in connection with the operation of envelope extracting circuit 13, A/D converter 14, and microcomputer 20, with reference to FIGS. 5 to 7.

As described above, the above circuit performs a time-division basis operation to detect the operations of the eight drum pads independently. In the following, an operation that takes place with a percussion operation of a single drum pad 10 will be described for the sake of simplicity of description.

In the following description, it is assumed that foot switch 121, which designates one of two different tones (in this example open highhat and closed highhat) to microcomputer 20, is connected to microcomputer 20. It is also assumed that foot switch 121 is operative with respect to a single particular drum pad, e.g., the first drum pad 10. When the first drum pad 10 is struck with foot switch 121 held depressed to be "on", first tone designation data stored in RAM 22 and a key-on command signal are sent out. When the same drum pad 10 is struck with foot switch 121 "off", second tone designation data stored in RAM 22 and a key-on command signal are sent out.

More specifically, when the first drum pad 10, i.e., a vibration plate thereof, is struck with a predetermined intensity by drumstick 12, the vibrations caused by the impact are sensed by pick-up 11 mounted on drum pad 10. Pick-up 11 thus produces an analog signal of a waveform, as shown in (A) in FIG. 5. This analog signal is fed to envelope-extracting circuit 13. Envelope-extracting circuit 13 thus produces an envelope signal having a waveform as shown in (B) in FIG. 5. The extracted envelope signal is fed to A/D converter 14 which then converts the input envelope signal into a digital signal at every output timing of the A/D start signal, shown in (C) in FIG. 5, which is provided periodically from timer 21 in microcomputer 20. Immediately after each output timing of the A/D start signal, A/D converter 14 feeds an end signal (shown in (D) in FIG. 5) indicative of the end of A/D conversion operation, to microcomputer 20.

Figure 5:
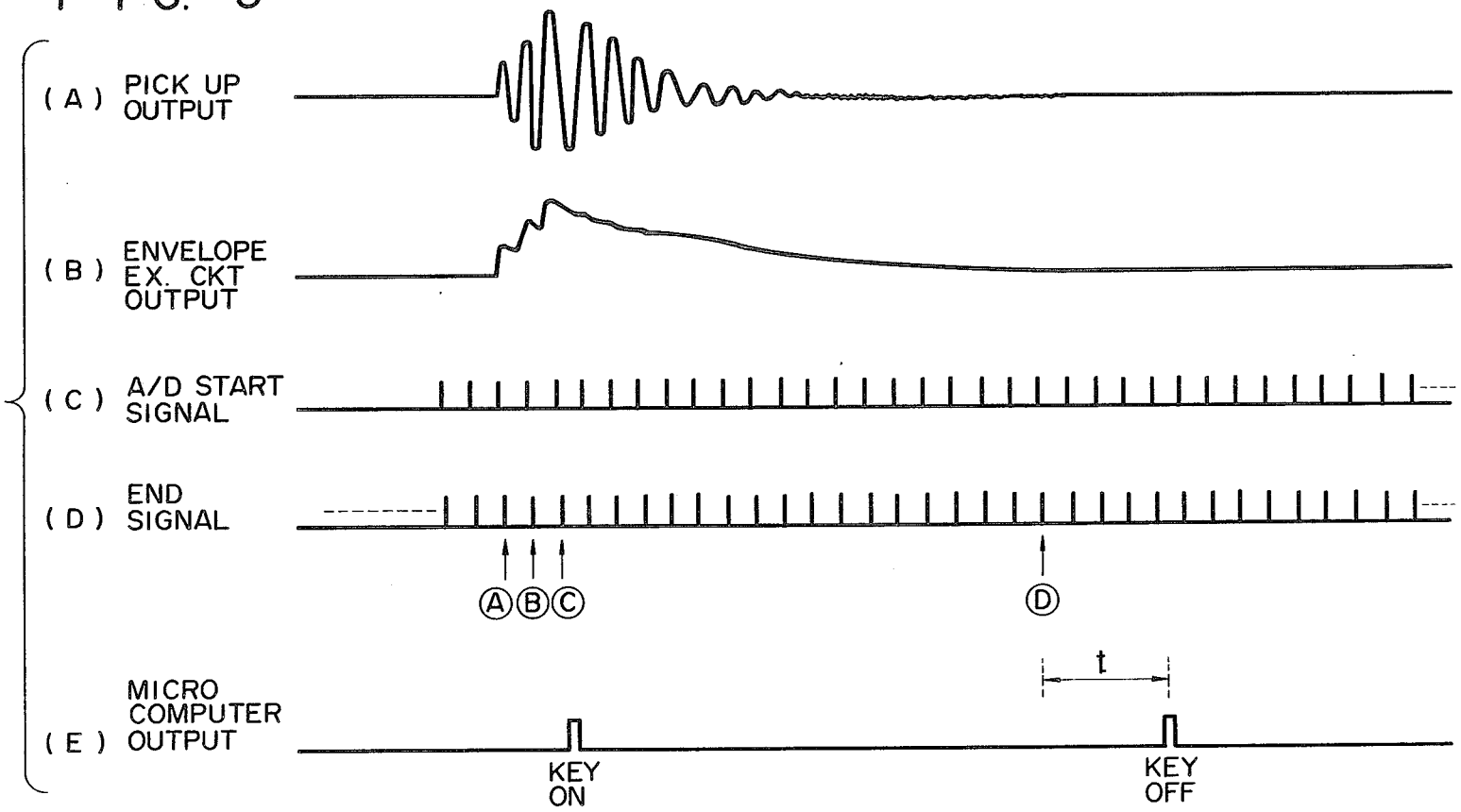
FIG. 5 is a timing chart for explaining the operation for envelope extraction.
Figure 6A:
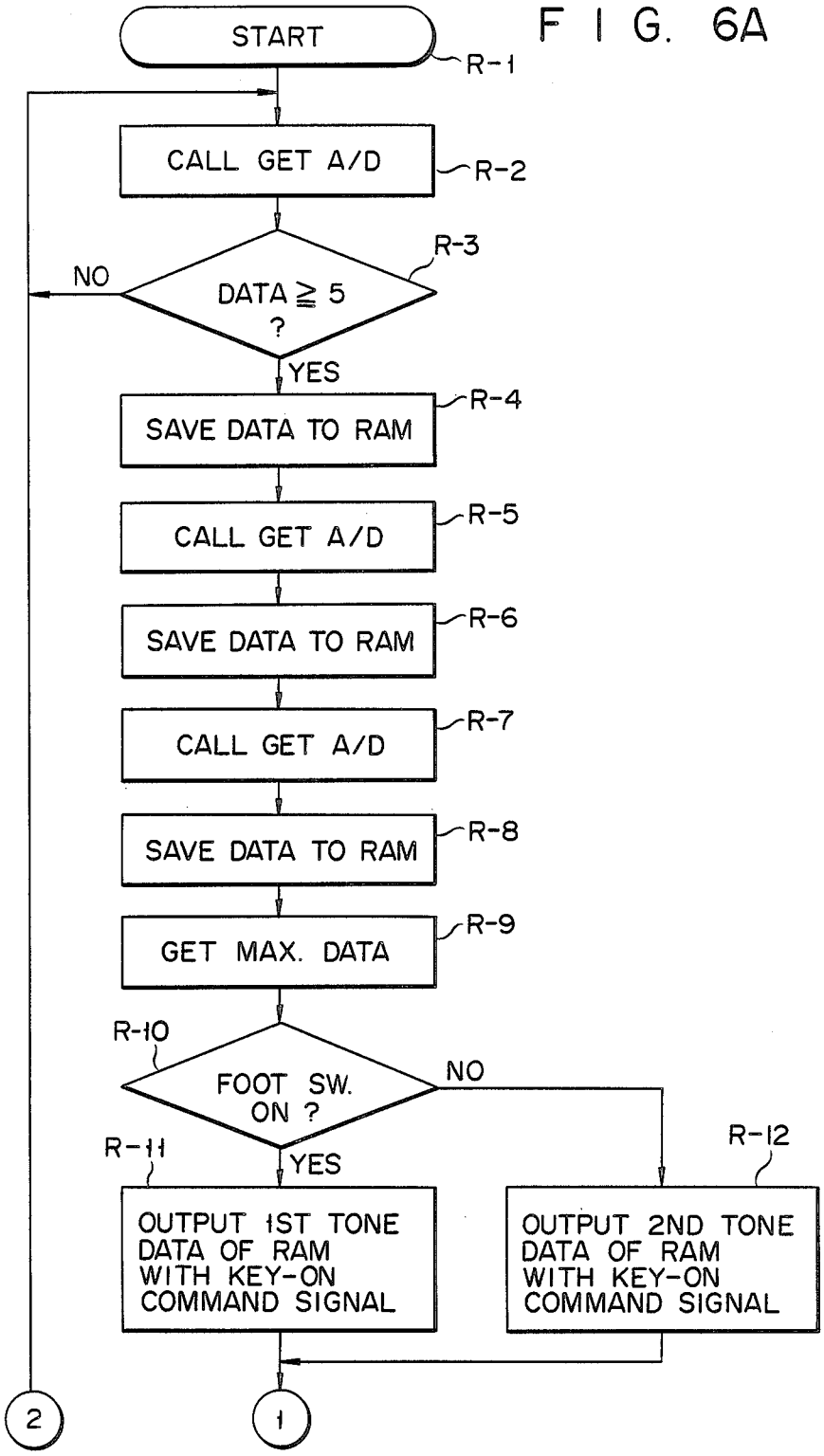
FIG. 6A to FIG. 6C show, in combination, a flow chart illustrating a detailed operation while the instrument is in the play mode.
Figure 6C:
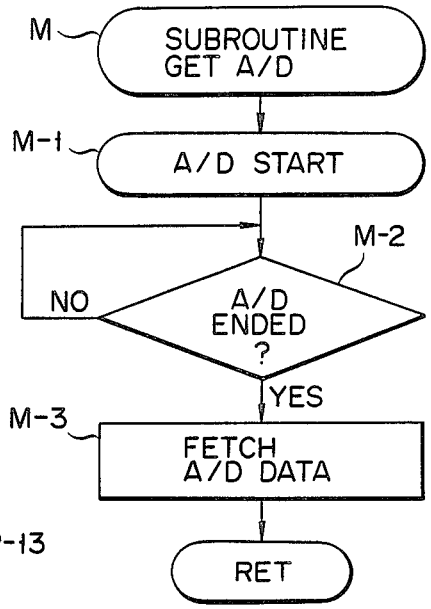
Figure 6B:
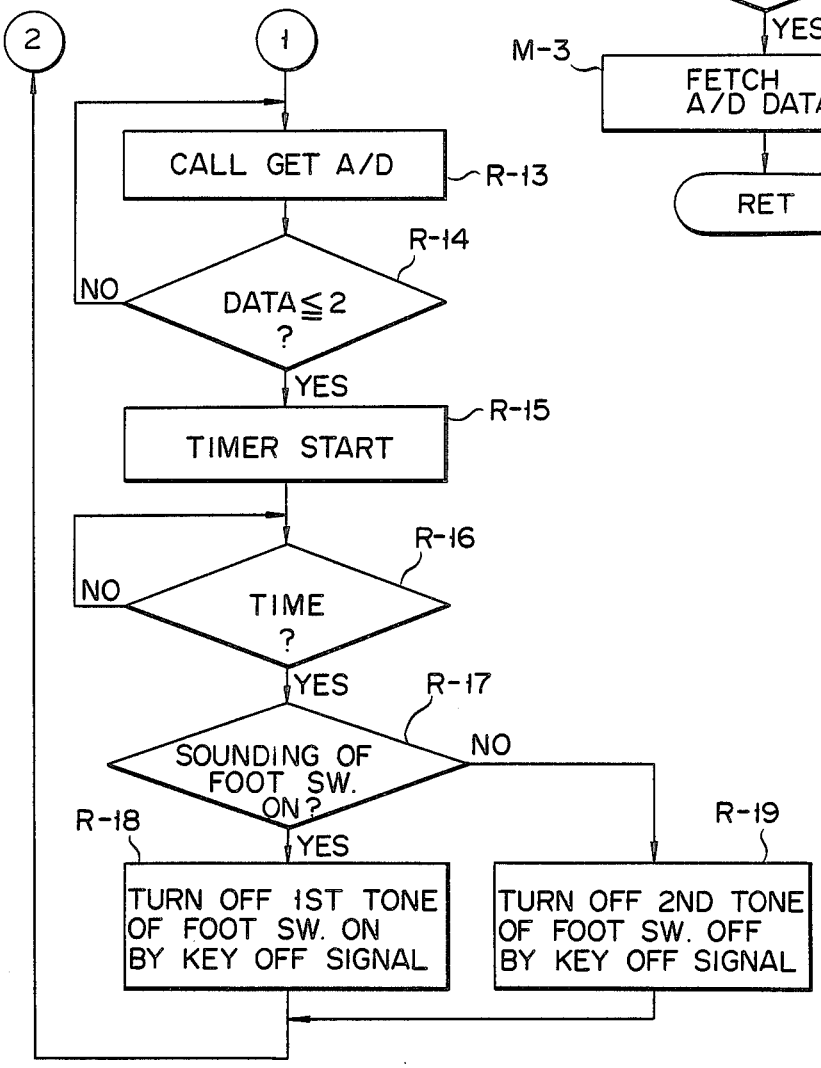

The digital signal provided from A/D converter 14 is processed in microcomputer 20, in a routine as shown in the flow chart of FIGS. 6A–6C. More specifically, microcomputer 20 starts the processing in step R-1 of FIG. 6A. In step R-2, process jumps to sub-routine M of FIG. 6C. In step M-1 of sub-routine M, an A/D start signal is fed to A/D converter 14 when a predetermined time interval has been counted by timer 21 in microcomputer 20. In subsequent step M-2, a check is performed as to whether there is an end signal indicative of the end of the conversion into a digital signal performed by A/D converter 14 according to the A/D start signal. If the end signal is detected, a decision "YES" is produced, and the routine goes to step M-3, in which microcomputer 20 fetches data of the digital signal. When the operation of step M-3, i.e., fetching of the digital signal data to microcomputer 20, is completed, the subroutine returns to the main routine, to execute step R-3. In step R-3, a check is performed as to whether the level of the digital signal fetched to microcomputer 20 is above "5". If the decision is "YES", the routine goes to step R-4, in which the fetched data (i.e., level of "5") is stored or saved in RAM 22. If the decision is "NO", the routine goes back to step R-2, to repeat the operation as described. In this embodiment, the digital signal has a level of, for instance, "13" at timing in Ⓐ (D) in FIG. 5. Since this value is above "5", it is saved in RAM 22. Through the operation of storing this level value of "13" in RAM 22, it is decided that drum pad 10 has been struck at this instant. In subsequent step R-5, the envelope signal at the timing of the next A/D start signal, i.e., timing Ⓑ in (D) in FIG. 5, is converted into a digital signal through steps M-1 to M-3 of sub-routine M. The digital signal is saved in RAM 22, in step R-6. Then, in step R-7, the envelope signal at the timing of the next A/D start signal (i.e., timing Ⓒ in (D) in FIG. 5) is converted into a digital signal, which is saved in RAM 22, in step R-8. In subsequent step R-9, the maximum level value among the level values "3" "28", and "40" of digital signal at timings Ⓐ, Ⓑ, and Ⓒ (i.e., value "40" in this case) is obtained. This maximum level value of "40" is regarded to be the intensity of impact of striking drum pad 10. In subsequent step R-10, a check is performed as to whether foot switch 121 is "on". If the decision is "YES", the first tone designation data in RAM 22 is designated, and in subsequent step R-11, this first tone designation data (i.e., channel code "01" and pitch No. "15") and tone volume designation data corresponding to the maximum level noted above are fed together with a key-on command, for the first channel, (i.e., code "40" in FIG. 7) to tone generator unit 27. According to this key-on command, the closed highhat tone is sounded from the tone generator for the first channel, on the basis of the data noted above. If the decision of the check in step R-10 is "NO", the second tone designation data in RAM 22 is designated. In this case, this second tone designation data (i.e., channel code "02" and pitch No. "20", in FIG. 7) and the tone volume designation data corresponding to the maximum level are fed together with a key-on command (code "40") to the tone generator unit for the second channel. Thus, the open highhat tone is sounded from the tone generator for the second channel, according to the key-on command and the various data noted above.

The closed highhat tone or open highhat tone sounded in step R-11 or R-12 is gradually attenuated until the level value of the digital signal from A/D converter 14 becomes "2". More specifically, in step R-13, sub-routine M is executed, and in subsequent step R-14, a check is performed as to whether the level value is less than "2". If the decision is "NO", the routine returns to step R-13. If the level value of the digital signal becomes less than "2" at timing Ⓓ in (E) in FIG. 5, step R-14 produces a decision "YES", and step R-15 is executed, in which timer 21 in microcomputer 20 is started. In subsequent step R-16, a check is performed as to whether a predetermined time t has passed from timing (D) noted above. If the decision is "YES", the routine goes to step R-17. If the decision is "NO", the routine returns to step R-15. In the case of the decision "YES", a check is performed, in step R-17, as to whether the prevailing tone is sounded with foot switch 21 "on". If the decision is "YES", step R-18 is executed, in which a key-off command (code "00") for discontinuing the closed highhat tone being generated with foot switch 121 "on" is fed to the tone generator unit for the first channel, thus causing quick attenuation of closed highhattone. If the decision is "NO", step R-19 is excuted, in which a key-off command (code "00") for discontinuing open highhat tone being generated with foot switch 121 "off" is fed to the tone generator unit for the second channel, thus causing quick attenuation of the open highhat tone.

As has been shown, either first or second tone designation data in RAM 22 in microcomputer 20 is selected by means of a switch-on or switch-off signal fed to the microcomputer, depending on whether foot switch 121 is "on" or "off". Thus, when drum pad 10 is struck, either the closed highhat tone or the open highhat tone can be sounded from the corresponding tone generator unit according to the selected tone designation data. In other words, two different tones can be selectively sounded with a simple construction using a single drum pad 10.

Further, the closed highhat tone is generated with foot switch 121 depressed, while the open highhat tone is generated with foot switch 121 released. Thus, even in the case of highhat as a usual natural percussion instrument, like the case of the above embodiment, it is possible to generate closed highhat with the foot switch depressed and generate open highhat with the foot switch released. In other words, it is possible to generate either closed highhat or open highhat tone in the same manner of depression as the highhat (symbal) of the original musical instrument.

Further, in the above embodiment, the analog signal from pick-up 11 installed on drum pad 10 is converted via A/D converter 14 into a digital signal before being produced as a musical tone from tone generator unit 27, unlike the prior art case where all the tones are processed analog-wise, it is possible to obtain a variety of tones, utilizing a simple construction.

Further, in the above embodiment, because a tone is generated on the basis of the maximum value of the level of digital signal produced from A/D converter 14, it is possible to generate a tone on the basis of the maximum impact of the striking of drum pad 10. It is thus possible to generate tones reliably every time.

Further, in the above embodiment, a predetermined time t is counted by timer 21 from the instant when the level value of digital signal from A/D converter 14 becomes less than "2", and attenuation of the tone being sounded is started according to a key-off command generated from microcomputer 20 after the lapse of the time noted above. Thus, even in case when drum pad 10 is struck immediately after the instant when the digital signal level value becomes less than "2" (frequently in case of an erroneous operation, such as a double striking), it is possible to prevent generation of consecutive tones due to the double striking. The tone being sounded thus can be quickly attenuated and discontinued.

Further, in the above embodiment, a tone of a volume or a timbre corresponding to the maximum level of the digital signal is generated. However, it is possible to generate a tone with a volume or a timbre corresponding to the level of the digital signal when the level exceeds a predetermined level at the timing of delivery of a certain A/D start signal.

Further, in the above embodiment, A/D converter 14 is provided between envelope-extracting circuit 13 and microcomputer 20, and a predetermined tone is generated on the basis of the provision of a digital signal above a predetermined level or at a maximum level, from A/D converter 14. However, it is possible to let the envelope signal from envelope-extracting circuit be fed directly to microcomputer 20, so that a predetermined tone is generated on the basis of the provision of an envelope signal above a predetermined level or at a maximum level from envelope extracting circuit 13.

Further, in the above embodiment, two different tones are selectively sounded depending on whether foot switch 121 is "on" or "off". However, it is also possible to cause selective sounding of two different tones depending on the "on" or "off" state of a manual switch instead of foot switch 121.

Further, while in the above embodiment two different tones are selectively sounded, it is also possible to let one of three or more different tones be selectively sounded.

Further various other changes and modifications of the above embodiment are possible without departing from the scope of the invention. For example, in response to the operation of one of system switches 5-1 to 5-4 shown in FIG. 2B, all corresponding preset data, i.e., preset parameter data for lines L1 to L8, may be provided together with a key-on command to tone generator unit 27, for effecting demonstration through loudspeaker 28. The user can thus confirm aurally the tones allotted to lines L1 to L8, i.e., from respective drum pads 10. Further, instead of or along with this, all preset data (system data) may be displayed cyclically or collectively on display section 7 in accordance with the operation of a particular system key.

Further, while in the above embodiment touch sensitive tone volume designation is performed through peak detection based on input data analysis, this processing may be omitted, if desired. Likewise, it is possible to dispense with the key-off command.

Further, in the above embodiment, an envelope signal is extracted from the analog voltage signal provided from pick-up 11 and is converted, in A/D converter 14, into a digital signal for the sounding start and end control noted above. It is possible to effect extraction of the envelope signal after conversion of the analog voltage signal from pick-up 11 into a digital signal. In this way, the same effects can be realized with a slight modification of the construction.

As has been shown in the foregoing, according to the invention, an envelope signal generated with the actuating of a vibration member is converted into a digital signal, and the start and end of the sounding of a desired tone are controlled according to this digital signal. Thus, it is possible to generate a variety of different performance tones reliably, utilizing a simple construction.

Further, according to the invention, setting means are provided to add programmable setting elements to parameter data contained in a tone control signal to be fed to the tone generation unit according to an analog signal from the analog trigger signal generator. Thus, it is possible to freely set and alter pitch data, timbre data, etc. The user thus can freely and easily construct an electronic musical instrument system according to a piece of music, to be performed or matched to his or her taste.

Further, a particular one of at least two different tones can be selectively sounded via a selective designation operation of a foot switch or similar designating means. Thus, by actuating a single vibration member, a particular one of at least two different tones can be selectively sounded. This means that tones rich in variation can be sounded, utilizing a simple construction.

Further, while the above embodiment of the invention has been applied to percussion instruments, the invention can of course be applied to electronic string musical instruments as well.

What is claimed is:

1. An electronic musical instrument comprising means for generating an electric signal representing vibrations of a vibration member operative for musical performance, and tone generating means for generating a predetermined tone signal according to said electric signal from said signal generating means, said electronic musical instrument further comprising:

envelope-extracting means for extracting an envelope signal from said electric signal:

analog-to-digital conversion means for converting said envelope signal from said envelope-extracting means into a digital signal; and control means for detecting a level of said digital signal for a predetermined number of times after the level of said digital signal from said analog-to-digital conversion means exceeds a predetermined value, and for controlling said tone generating means to generate a tone with at least one timbre and volume variably controlled in accordance with a detected maximum level of the digital signal.

2. An instrument according to claim 1, wherein said control means includes first means for instructing the start of said tone, by detecting that the level of said digital signal from said analog-to-digital converting means exceeds a predetermined level.

3. An instrument according to claim 1, wherein said control means includes second means for instructing the stopping of said tone, by detecting that the level of said digital signal from said analog-to-digital conversion means has become less than a predetermined value.

4. The instrument according to claim 1, wherein said control means includes:

memory means for storing each detected level for a predetermined number of times after the level of said digital signal from said analog-to-digital conversion means exceeds said predetermined value;

detecting means for detecting said maximum level as a maximum one of the level values provided from said memory means; and instructing means for instructing said tone generating means to generate the tone signal according to said maximum value detected by said detecting means.

5. The instrument according to claim 1, wherein said signal generating means includes a member being struck, and wherein said member being struck includes a drum pad, a pick-up being provided on said drum pad for producing an electric signal when said drum pad is struck.

6. The instrument according to claim 5, wherein said envelope-extracting means includes:

a coupling capacitor, to which the output signal of said pick-up is fed;

an operational amplifier having an output terminal, an inverted input terminal and a non-inverted input terminal, to which the output of said coupling capacitor is fed;

a diode having an output terminal and coupled to the output terminal of said operational amplifier;

a time-constant circuit connected to the output terminal of said diode; and a variable resistor for sensitivity control coupled to the output terminal of said diode and to the inverted input terminal of said operational amplifier;

the output of said diode being fed to said analog-to-digital conversion means.

7. The instrument according to claim 1, wherein said signal generating means includes a member to be struck, and wherein said member to be struck includes a vibration member and a piezoelectric transducer for generating an electric signal by detecting vibrations of said vibration member produced when said vibration member is struck.

8. The instrument according to claim 1, wherein said control means includes a microcomputer, means for providing an analog-to-digital conversion-start signal to said analog-to-digital conversion means, to start an analog-to-digital conversion process, and said analog-to-digital conversion means provides an end signal to end one cycle of analog-to-digital conversion processing.

9. The instrument according to claim 1, wherein said control means includes:

setting means for setting parameter data of a tone control signal fed to said tone generating means;

and wherein said tone generating means generates a corresponding tone signal according to said parameter data from said setting means and said digital signal from said analog-to-digital conversion means.

10. The instrument according to claim 9, wherein said parameter data set by said setting means are a pitch designation code data and a timbre designation code data.

11. The instrument according to claim 9, wherein said setting means includes:

manual selective input means for manually selecting parameter data; and memory means for storing selected parameter data.

12. The instrument according to claim 11, wherein said setting means includes display means for displaying parameter data selected by said manual selective input means.

13. The instrument according to claim wherein:

said signal generating means includes a member to be struck, said tone generating means generates tones in accordance with the striking of said plurality of members to be struck; and said setting means includes series data call means for collectively taking out a series of parameter data set for said plurality of members to be struck, from said memory means.

14. The instrument according to claim 11, wherein said setting means includes selective data call means for selectively taking out one of a plurality of parameter data stored in said memory means.

15. The instrument according to claim 13, wherein said setting means includes output control means for providing a tone control signal, including a series of parameter data to said tone generating means, when the series of parameter data are called by said series data call means.

16. The instrument according to claim 1, wherein said control means includes:

a manually-operative switch; and instructing means for instructing selective generation of at least two different tone signals from said tone generating means according to the operating state of said manually-operative switch.

17. The instrument according to claim 16, wherein said manually-operative switch is a foot switch, and an open highhat tone and a closed highhat tone are designated as tones to be selectively generated from said tone generating means via operation of said foot switch.

18. An electronic musical instrument comprising:

a plurality of members to be struck;

a plurality of envelope extracting means, one provided for each of said members to be struck, for extracting envelope signals from analog electric signals generated by the striking of said members to be struck;

a signal analog-to-digital conversion means, to which said envelope signals provided from said plurality of envelope-extracting means are commonly fed on a time-division basis;

control means for detecting a level of said digital signal for a predetermined number of times after the level of said digital signal from said analog-to-digital conversion means exceeds a predetermined value, and for controlling said tone generating means to generate a tone with at least one of timbre and volume variably controlled in accordance with a detected maximum level of the digital signal; and tone signal generating means for simultaneously generating tone signals corresponding in number at most to the number of said members to be struck under control of said control means.

19. The instrument according to claim 18, wherein said control means controls at least one of timbre and volume of the tone signal generated from said tone signal generating means for each of said plurality of members to be struck according to the status of generation of digital signals obtained from said signal analog-to-digital conversion means.

20. An electronic musical instrument comprising:

a vibration member to be struck at the time of musical performance;

vibration detecting means for detecting vibrations of said vibration member when said vibration member is struck;

envelope-extracting means for extracting an envelope signal according to the output of said vibration detecting means;

analog-to-digital conversion means for converting the envelope signal from said envelope extracting means into said digital signal; and tone control means for detecting a level of said digital signal for a predetermined number of times after the level of said digital signal from said analog-to-digital conversion means exceeds a predetermined value, and for controlling said tone generating means to generate a tone with at least one of timbre and volume variably controlled in accordance with a detected maximum level of the digital signal.

21. The instrument according to claim 20, wherein said tone control means includes memory means for storing the level of the digital signal from said analog-to-digital conversion mans several times after said level exceeds a predetermined level, and a tone is generated according to said maximum level among the stored levels of the digital signal in said memory means.

22. The instrument according to claim 20, wherein said tone control means effects control to discontinue generation of a tone when the level of the digital signal from said analog-to-digital conversion means becomes a predetermined level or a level slightly lower than said predetermined level.

23. The instrument according to claim 22, wherein said tone control means effects control to discontinue generation of a tone after lapse of a predetermined time from the instant when the level of the digital signal from said analog-to-digital conversion means becomes a predetermined level or a level slightly lower than said predetermined level.

24. An electrical musical instrument comprising:

analog trigger-signal generating means for generating an analog-trigger-signal in response to a performance operation of a performer;

signal conversion means for converting said analog trigger-signal from said analog trigger-signal generating means into a digital signal, for detecting a level of said digital signal for a predetermined number of times after the level of said digital signal exceeds a predetermined value, and for detecting a maximum level in the detected values to generate the digital signal at the maximum level as a tone control signal;

tone signal generating means for generating a tone signal according to said tone control signal generated from said signal conversion means; and parameter data-setting means for setting parameter data contained in said tone control signal generated from said signal conversion means.

25. The instrument according to claim 24, wherein said parameter data include a pitch designation code data and a timbre designation code data.

26. The instrument according to claim 24, wherein said parameter data-setting means includes manual-selective input means for manually selecting parameter data and memory means for storing selected parameter data.

27. The instrument according to claim 26, wherein said parameter data-setting means includes display means for displaying parameter data selected by said manual-selective input means.

28. The instrument according to claim 26, wherein said parameter data-setting means includes output control means for providing tone control data containing parameter data to said tone generating means when said parameter data is selected by said manual-selective input means.

29. The instrument according to claim 26, wherein said parameter data-setting means includes series data call means for collectively taking out a series of parameter data set with respect to a plurality of analog signal generating means in said memory means.

30. The instrument according to claim 26, wherein said parameter data-setting means includes selective data call means for selectively taking out one of a plurality of parameter data stored in said memory means.

31. The instrument according to claim wherein 29, wherein said parameter data-setting means includes output control means for providing tone control data including a series of parameter data to said tone generating means when a series of parameter data are called by said series data call means.

32. An electronic drum apparatus comprising:

a plurality of drum pads;

a plurality of mechanical-to-electrical transducer means, one provided for each of said drum pads, for detecting mechanical vibrations of the drum pad when the drum pad is struck and converting the detected vibrations into a corresponding electric signal;

a plurality of envelope-extracting means, one provided for each of said plurality of mechanical-to-electrical transducer means, for extracting an envelope signal from said electric signal;

a signal analog-to-digital conversion means, to which said envelope signals from said plurality of envelope-extracting means are fed on a time-division basis;

a tone generating means;

computer means connected to said signal analog-to-digital conversion means, for being supplied with a plurality of digital signals obtained in accordance with the striking of said plurality of drum pads, for detecting a level of said digital signal for a predetermined number of times after the conversion means exceeds a predetermined value, and for controlling said tone generating means to generate a tone with at least one of timbre and volume variably controlled in accordance with the detected maximum level of the digital signal;

manual input-setting means connected to said computer means, for manually setting parameter data determining the characteristics of sounds to be generated; and sound generating means connected to said computer means, for simultaneously generating sounds corresponding to said plurality of drum pads;

said sound generating means being supplies with a tone designation signal based on said parameter data set by said manual input setting means and said tone generation command from said computer means, to determine the timbre and volume of sounds being generated by the sound generating means.

33. An electronic musical instrument comprising means for generating an electric signal representing vibrations of a vibration member operative for musical performance, and tone generating means for generating a predetermined tone signal according to said electric signal from said signal generating means, said electronic musical instrument further comprising:

envelope-extracting means for extracting an envelope signal from said electric signal;

analog-to-digital conversion means for converting said envelope signal from said envelope-extracting means into a digital signal; and control means for discontinuing the generation of tone from said tone generating means when the level of said digital signal from said analog-to-digital conversion means becomes a predetermined value or a value slightly lower than said predetermined value.

34. The instrument according to claim 33, wherein said control means includes delay means for discontinuing the generation of said tone after the laps of a predetermined period of time from the instant when the level of said digital signal from said analog-to-digital conversion means becomes said predetermined value or a value slightly lower than said predetermined value.

35. The instrument according to claim 33, wherein said control means includes means for controlling the status of generation of said tone signal from said tone signal generating means according to a peak value of said digital signal from said digital signal generating means.

36. The instrument according to claim 33, wherein said control means includes instructing means for instructing the start of generation of said tone signal to said tone signal generating means when the level of said digital signal from said digital signal generating means exceeds a predetermined value.

37. An electronic musical instrument comprising:

a vibration member to be struck at the time of musical performance;

vibration detecting means for detecting vibrations of said vibration member when said vibration member is struck;

envelope-extracting means for extracting an envelope signal according to an output of said vibration detecting means;

analog-to-digital conversion means for converting the envelope signal from said envelope extracting means into said digital signal; and tone control means for detecting that the level of the digital signal from said analog-to-digital conversion means exceeds a predetermined level and for effecting control to cause generation of a tone according to the digital signal above said predetermined level.

38. The instrument according to claim 37, wherein said tone control means includes control means for effecting control to cause selective generation of at least two different tones in response to the rise of an envelope signal from said envelope-extracting means; and instructing means for instructing the generation of one of at least two different tones to said tone control means.

* * * * *